United States Patent [19]

de Brabant

[11] 4,434,595

[45] Mar. 6, 1984

[54] BUILDING STRUCTURE

[76] Inventor: Jean de Brabant, 465 Saint-Jean, Suite 1005, Montreal, Quebec H2Y 2R6, Canada

[21] Appl. No.: 380,879

[22] Filed: May 21, 1982

[30] Foreign Application Priority Data

Jul. 23, 1981 [CA] Canada ..... 382360

[51] Int. Cl.[3] ..... E04H 1/00

[52] U.S. Cl. ..... 52/236.2; D25/31

[58] Field of Search ..... 52/236.1, 236.2, 236.3, 52/202; 126/417; D25/5, 31, 32

[56] References Cited

U.S. PATENT DOCUMENTS

| | | |
|---|---|---|
| D. 208,090 | 7/1967 | Tesch . |
| D. 216,424 | 1/1970 | Estes . |
| D. 222,343 | 10/1979 | Mullen . |
| D. 230,724 | 3/1974 | Infante . |
| D. 243,955 | 4/1977 | Kosinski . |
| 1,512,975 | 10/1924 | Bright . |
| 1,991,695 | 2/1935 | Petrovitch . |
| 2,154,897 | 4/1939 | Grant . |
| 2,156,859 | 5/1939 | Lowe . |
| 3,337,999 | 8/1967 | Prus . |
| 3,535,835 | 10/1970 | Küpper . |
| 3,754,364 | 8/1973 | Ice . |
| 4,136,492 | 1/1979 | Willingham . |
| 4,156,994 | 6/1979 | Steuer . |

FOREIGN PATENT DOCUMENTS

| | | |
|---|---|---|
| 679826 | 1/1930 | France . |
| 41143 | 4/1931 | France . |
| 381846 | 11/1962 | Switzerland . |

OTHER PUBLICATIONS

Progressive Architecture, Apr. 1980, p. 133.
Progressive Architecture, Aug. 1978, p. 71.
Progressive Architecture, Nov. 1980, p. 95.
Progressive Architecture, Jan. 1981, p. 138.

*Primary Examiner*—John E. Murtagh
*Assistant Examiner*—Kathryn L. Ford
*Attorney, Agent, or Firm*—Bradford E. Kile

[57] ABSTRACT

A building structure is disclosed which comprises a central core with a plurality of habitable areas extending radially outwardly therefrom in the manner of spokes of a wheel. Glassed-in walls extend between the spokes to provide a plurality of climate-controlled atria. Facades on the sides of the spokes adjoining the atria also have glassed-in walls providing a view of both the atria and the outdoors from within the habitable areas. The horizontal section of the building may be circular, oblong or polygonal.

16 Claims, 4 Drawing Figures

BUILDING STRUCTURE

This invention relates to building structures; more particularly it relates to an enclosed building, the perimeter of which is in glass and the interior of which contains built useable spaces as well as a number of atria.

The horizontal section of the building comprises a central core with useable or habitable areas extending radially outwards from the central core in the manner of spokes of a wheel. The number of spokes may vary according to the particular use of the building and the details of the design.

The overall concept of the building is that of a multistory glassed-in tower which may be cylindrical in form. However, not all the spokes need be of the same length. Thus, the horizontal section may be oval or oblong, for example, rather than circular. Moreover, the exterior walls joining the outer ends of successive spokes may be planar rather than arcuate causing the horizontal section to be polygonal. Other modifications are possible in which some exterior walls are arcuate and others planar.

The atria are formed by the spaces between the facades of the useable spaces within the spokes and the perimeter walls joining the outer ends of successive spokes.

It is an important feature of the invention that there is provided an enclosed building having useable or habitable space, such as office or hotel rooms, enclosed within the radially extending spokes with a maximum visible exposure both to the environmentally controlled atria and also to the outdoors through the exterior glass walls of the atria.

Ideally, the full expanse of one of the atria should be visible from each of the rooms or enclosed areas in the spokes through the glassed-in walls of the facades. There should also be a relatively wide-angled view of the outdoors from within any given habitable room through the glass perimeter wall of the associated atrium. It is a general objective of the invention that the habitable area will have such views of the atria and outdoors.

The ratio of the length of the peripheral wall of an atrium to the total length of the facades adjoining is obviously closely related to the angle between the two facades of a particular atrium and to the number of spokes.

There are already known various building structures which have one or more atria adjoining exterior walls thereof. Any such structures which are known to the applicant provide a view of the atria only from a very limited portion of the habitable area of the building let alone of the outdoor space beyond. In determination of the merits of the present invention it is of prime importance to note the advantages which accrue from the geometric configuration and topology of the structure employed. In relation to this particular aspect of the invention the elements with which it deals are:

1. The geometry of the habitable space;
2. The geometry of the exterior envelope; and
3. The total projection of the building in relation to the ground.

The synergistic effect of applying the spoked wheel-atrium concept to the three aforesaid elements is to produce the maximum possible simultaneous exposure of the facades of the habitable space to space within the atria and to the outdoors. This very advantageous effect is produced whether the exterior envelope of the building takes a cylindrical, an oblong or a polygonal form.

There are also known a number of prior art building structures having a plurality of radially extending or elongated habitable units emanating from a central core or unit. Examples of such prior art structure are found in U.S. Pat. No. 2,154,897 issued April 18, 1939 to Henry M. Grant and in U.S. Pat. No. De. 216,424 issued Jan. 6, 1970 to Moreay P. Estes and Joseph Kott. Such structures, while they do provide an improvement in viewing access to the outdoors, are by no means comparable to the structure of the present invention since they do not have enclosed atria located between the radially extending wings.

Multi-level habitable buildings of polygonal or cylindrical form with radially extending divisions which may extend from a central core are also known. Examples of such buildings are found in U.S. Pat. No. 4,136,492 issued Jan. 30, 1979 to John H. Willingham and U.S. Pat. No. De. 208,090 issued July 18, 1967 to George D. Tesch. Such buildings, however, fail entirely to accomplish the purpose of the instant invention since they neither have atria which are visible from the majority of habitable units nor do they possess a view of the outdoors from the various portions of the habitable area as does the structure of the instant invention.

It is axiomatic that most heat exchange in a building takes places at the periphery thereof. Such buildings as those described in U.S. Pat. No. 2,154,897 and U.S. Pat. No. De. 216,424 clearly have a very large external surface area in proportion to that enclosed, and hence are quite energy-inefficient. The periphery of the building structure of the instant invention is normally either equal to or less than $\pi$ times the diameter. Were the perimeter glass shield which encloses the atria removed the length of the facades which would be exposed to the exterior would be greatly increased; typically, the external surface of the building then would be increased by 2 to 3 times.

An energy study has been carried out to determine the air conditioning and heating requirements of building structures of the present invention having 4 and 5 spokes with the requirements of a conventional rectangular building of modern design. The results of this study are very favourable in that the energy expenditure is similar to that of a conventional building of the same habitable area. An average additional expenditure of approximately 12% would be necessary for the atria whereas the volume of the atria is much greater than 12% as compared with the habitable area. Thus in addition to the extraordinary climate offered by the atria is the fact that the structure is very energy-efficient.

On sunny days a large proportion of the energy needed to heat the portions of buildings not exposed to the sun can come from the sun heating the favoured atria. The energy may be recuperated in water to permit easy transfer to the opposite side of the building.

In order to minimize energy losses from the atria during the night and in sunless periods it is desirable to increase the thermal resistance of the atrium walls.

The energy requirements may also be reduced during winter weather by maintaining the temperature within the atria lower than that in the habitable area but high enough that plants can survive.

It is a general object of the invention to provide a building structure with a plurality of habitable units having enhanced viewing exposure to areas outside the habitable units.

It is a further object of the invention to provide a building structure which includes a habitable area and a plurality of enclosed atria and which structure has a geometric configuration such as to provide optimum viewing exposure of both the atria and space external to the building from within the habitable area.

It is a further object of the invention to provide a building structure which is enery-efficient at least to the extend that the ratio of external surface area to enclosed space is relatively small.

The abovenoted and other objects of the invention are accomplished by the provision of a unique building structure with habitable space which in horizontal section comprises a central core and a plurality of spokes extending radially outwardly from said central core, a plurality of said successive spokes being connected by associated peripheral walls to form a plurality of enclosed atria each disposed between an associated pair of spokes, and said atria being circumferentially disposed around said central core.

In addition to the aforementioned functional and other practical advantages of the building structure of the invention deriving from the combination of spoke-wheel habitable area and enclosed atria is the fact that the design has considerable aesthetic merit. Not only does it provide a pleasing view from within the habitable area in the spokes but it also has an attractive external apperarance.

Other objects, advantages and features of the invention will become apparent from the following description of exemplary embodiments thereof taken in conjunction with the accompanying drawings, in which.

Figure 1:
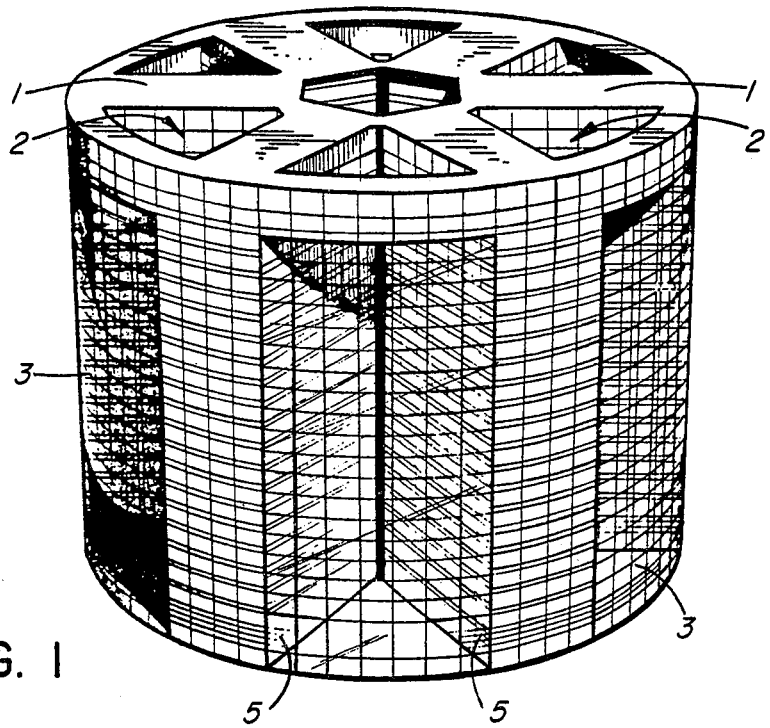
FIG. 1 is a perspective view of an embodiment of the invention.

The embodiment illustrated in FIG. 1 contains 6 spokes or wings 1 extending radially from a central area and having located between each successive pair of spokes an atrium 2 enclosed by a glassed-in wall 3. The spokes as shown in FIG. 1 are all of the same length and the exterior walls of the atria comprise circular arcs providing an overall cylindrical outline. The central area in accordance with FIG. 1 contains an additional atrium. However, it will be understood that this is not an essential feature of the invention. As will be explained in the following, the central area may be utilized for various other purposes.

It will also be understood that while the atria, including the central one, are shown in FIG. 1 as being open at the top they may equally well be covered by a roof which may advantageously take the form of a skylight.

Each atrium has a horizontal section in the form of a sector of a circle bounded on the sides by facades 5 of the associated spokes. The walls of the facades normally are of glassed-in construction to provide an optimum view from the habitable area within the spokes of the adjoining atrium and also of the outdoors through the transparent peripheral wall of the atrium.

Figure 2:
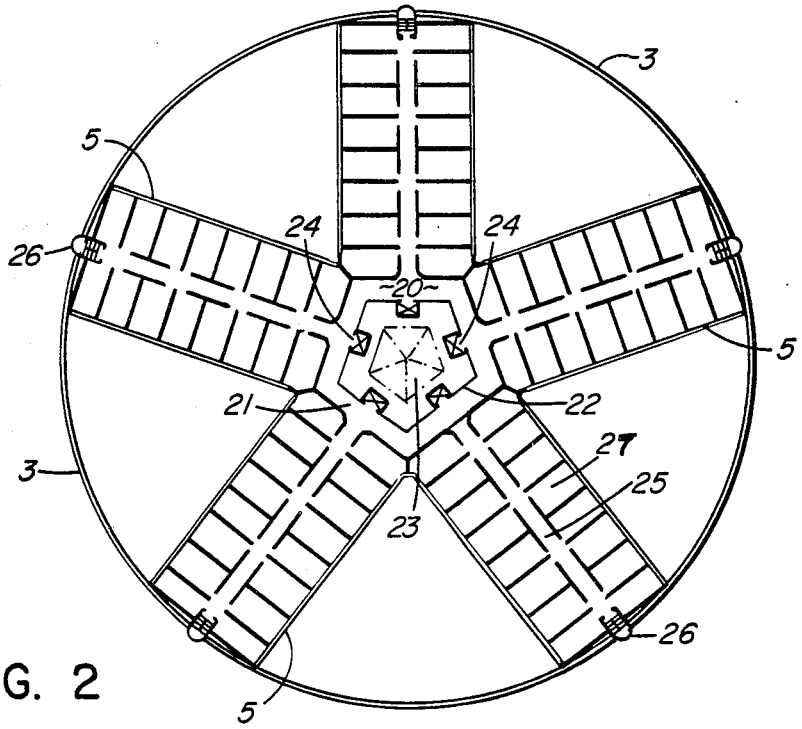
FIG. 2 is a plan view of an embodiment of the invention having a cylindrical shape.

FIG. 2 shows a horizontal section of an embodiment of the invention which is very similar to that of FIG. 1 except that it contains five spokes rather than six. Each of the walls 3 and 5 bordering an atrium are of glass.

Within and around the circumference of the pentagonal central area 20 in FIG. 2 is a continuous passageway 21 which provides access in turn to each of the areas within the spokes. The area enclosed by passageway 21 consists mainly of a pentagonal atrium 22 covered by a skylight 23. Also, located within the atrium 22 are elevator shafts 24 with access from passageway 21.

Each of the spokes contains a central longitudinal passageway 25 extending from passageway 21 to the outer end of the spoke where a stairway 26 is located.

On either side of passageway are rooms 27, each having one end wall forming a portion of a facade.

Figure 3:
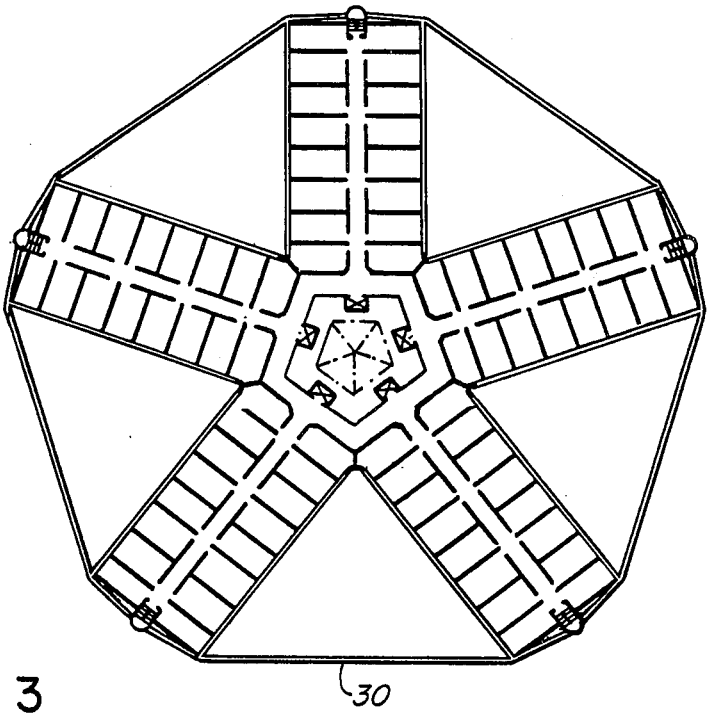
FIG. 3 is a plan view of an embodiment of the invention having spokes of equal length, the outer peripheral walls of the atria being planar.

FIG. 3 shows a horizontal section of an embodiment which differs from that of FIG. 2 only in that the peripheral walls 30 of the atria are planar giving the horizontal section of the building a generally polygonal shape.

Figure 4:
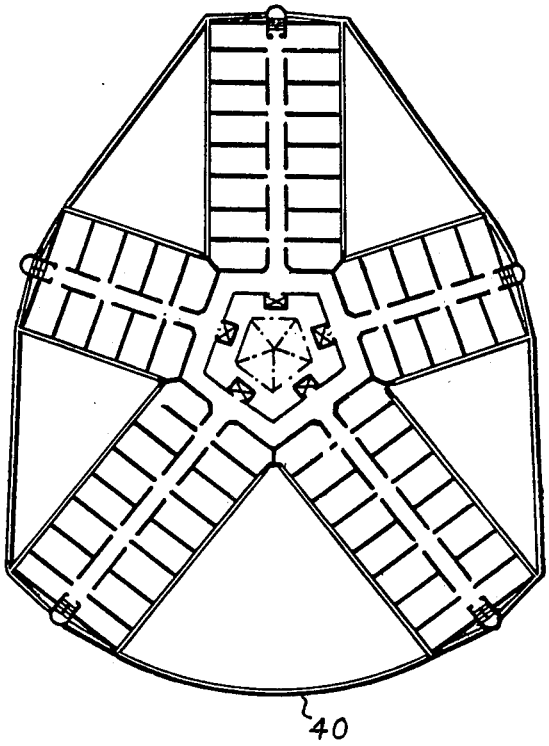
FIG. 4 is a plan view of an embodiment of the invention having an oblong configuration in horizontal section.

FIG. 4 is an example of a variant of the building structure of the invention in which the spokes are of different lengths causing the horizontal section as illustrated to have an oblong shape. Here it will be noted that the peripheral wall 40 of one atrium is arcute whereas the other peripheral walls of the other atria are planar.

Although each of the disclosed embodiments includes an atrium in the central area such as atrium is not an essential feature of the invention. It may well be desirable in a certain case to utilize the central area for services such as elevators and/or for heating and air-conditioning equipment.

It is desirable to provide a means to circulate air between the atria and other portions of the building structure. This is advantageous since the atria may be expected to receive heat from sunlight and hence such circulation of air will be beneficial in helping to heat the habitable area. Alternatively, as previously noted, it may be found to be advantageous to transfer energy from one portion of the structure to another by the circulation of water.

It will be understood that the described embodiments are exemplary only. Many other variations of the structure are possible. For example, it is not essential that the facades of a particular spoke be parallel to one another. The invention includes all such variations as would occur to one skilled in the art and is delineated not by the preceding examples but solely by the appended claims.

I claim:

1. A multi-story exterior atrium building comprising:

a multi-story habitable space which in horizontal section includes at each story, a central core, and a plurality of habitable spokes extending radially outwardly from said central core, a substantially transparent peripheral wall means connecting the outer ends of adjacent habitable spokes to form a plurality of enclosed exterior atria, each of said exterior atria being disposed between an associated pair of said habitable spokes, said plurality of atria being circumferentially disposed around said central core and vertically extending substantially throughout the height of said multi-story building, and an outwardly extending side of each of said habitable spokes includes a facade bordering on an associated one of said atria and containing at least one transparent portion wherein as associated exterior atria and space external to the building may be viewed from within the spokes and wherein the exterior surface area of said habitable spokes substantially exceeds the exterior surface area of said exterior atrium building.

2. A building structure as claimed in claim 1 wherein the outer ends of all said successive spokes are joined by associated peripheral walls whereby the entire structure is circumferentially enclosed by said peripheral walls.

3. A building structure as claimed in claim 1 wherein said peripheral walls are arcuate in horizontal section.

4. A building structure as claimed in claim 1 wherein said peripheral walls are planar.

5. A building structure as claimed in claim 1 wherein the peripheral walls of the facades comprise glass.

6. A building structure as claimed in claim 2 wherein the external surface of said building structure is substantially cylindrical.

7. A building structure as claimed in claim 2 wherein the external surface of said building structure is oblong in horizontal section.

8. A building structure as claimed in claim 6 wherein the perimeter of said building structure in horizontal section is not greater than $\pi$ times the diameter.

9. A building structure as claimed in claim 7 wherein the perimeter of said building structure is not greater than $\pi$ times the average diameter.

10. A building structure as claimed in claim 1 wherein means is provided to promote heat exchange between at least one of the atria and the habitable area of the structure.

11. A building structure as claimed in claim 2 wherein the external surface of said building structure is substantially polygonal in horizontal section.

12. A building structure as claimed in claim 11 wherein the atria when exposed to sunlight act as hat reservoirs to provide heat which is made available to other areas within the structure.

13. A building structure as claimed in claim 1 wherein said central core contains service facilities for the structure.

14. A building structure as claimed in claim 1 wherein said central core comprises an atrium.

15. A building structure as claimed in claim 1 wherein each spoke has a central corridor extending radially therealong and a plurality of rooms on each side of said central corridor.

16. A building structure as claimed in claim 15 wherein said central core has a circumferential corridor communicating with each of the corridors of the spokes.

* * * * *